US006926778B2

(12) United States Patent
Iseda et al.

(10) Patent No.: US 6,926,778 B2
(45) Date of Patent: Aug. 9, 2005

(54) AUSTENITIC STAINLESS STEEL EXCELLENT IN HIGH TEMPERATURE STRENGTH AND CORROSION RESISTANCE, HEAT RESISTANT PRESSURIZED PARTS, AND THE MANUFACTURING METHOD THEREOF

(75) Inventors: Atsuro Iseda, Kobe (JP); Hiroyuki Semba, Sanda (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 99 days.

(21) Appl. No.: 10/414,306

(22) Filed: Apr. 16, 2003

(65) Prior Publication Data

US 2003/0198567 A1 Oct. 23, 2003

(30) Foreign Application Priority Data

Apr. 17, 2002 (JP) ..... 2002-114138

(51) Int. Cl.[7] ..... C22C 38/24

(52) U.S. Cl. ..... 148/327; 148/428; 148/442; 420/43; 420/44; 420/46; 420/47; 420/448; 420/449; 420/584

(58) Field of Search ..... 148/327, 428, 148/442; 420/43, 44, 46, 47, 448, 449, 584

(56) References Cited

U.S. PATENT DOCUMENTS

| | | | | |
|---|---|---|---|---|
| 4,058,416 A | | 11/1977 | Eiselstein et al. | |
| 4,842,823 A | | 6/1989 | Sawaragi et al. | |
| 5,021,215 A | * | 6/1991 | Sawaragi et al. | 420/584.1 |
| 5,437,743 A | | 8/1995 | Culling | |
| 5,547,523 A | | 8/1996 | Blankenship, Jr. et al. | |

FOREIGN PATENT DOCUMENTS

| | | | |
|---|---|---|---|
| EP | 0381121 | | 8/1990 |
| EP | 0726333 | | 8/1996 |
| JP | 57-041356 | | 3/1982 |
| JP | 58-087224 | | 5/1983 |
| JP | 61147837 | * | 7/1986 |
| JP | 61-179833 | | 8/1986 |
| JP | 63-183155 | | 7/1988 |
| JP | 02-025519 | | 1/1990 |
| JP | 07-216511 | | 8/1995 |
| JP | 11-021624 | | 1/1999 |
| JP | 2000-001759 | | 1/2000 |

OTHER PUBLICATIONS

J.R. Davis: "ASM Specialty Handbook—Heat–Resistant Materials", 1997, ASM International, Ohio, USA, ppg. 230–231, 244–246.

* cited by examiner

*Primary Examiner*—Sikyin Ip
(74) *Attorney, Agent, or Firm*—Clark & Brody

(57) ABSTRACT

An austenitic stainless steel suited for ultra supercritical boilers, which consists of C: 0.03–0.12%, Si: 0.1–1%, Mn: 0.1–2%, Cr: not less than 20% but less than 28%, Ni: more than 35% but not more than 50%, W: 4–10%, Ti: 0.01–0.3%, Nb: 0.01–1%, sol. Al: 0.0005–0.04%, B: 0.0005–0.01%, and the balance Fe and impurities; and also characterized by the impurities whose contents are restricted to P: not more than 0.04%, S: not more than 0.010%, Mo: less than 0.5%, N: less than 0.02%, and O (oxygen): not more than 0.005%. Heat resistant pressurized parts excellent in thermal fatigue properties and structural stability at high temperatures, which have a coarse grain whose grain size number is 6 or less, and whose mixed grain ratio is 10% or less.

12 Claims, No Drawings

AUSTENITIC STAINLESS STEEL EXCELLENT IN HIGH TEMPERATURE STRENGTH AND CORROSION RESISTANCE, HEAT RESISTANT PRESSURIZED PARTS, AND THE MANUFACTURING METHOD THEREOF

TECHNICAL FIELD

The present invention relates to an austenitic stainless steel suited for such use as pipes or tubes, steel plates or sheets, steel bars and forgings (hereinafter collectively referred to as "heat resistant pressurized parts"), which constitute power generation boilers or heating furnaces for the chemical industry. The present invention also relates to heat resistant pressurized parts made of the above steel, excellent in high temperature strength and corrosion resistance, and to the manufacturing method of these parts.

These parts are excellent in high temperature strength and corrosion resistance as well as in thermal fatigue properties and microstructural stability (hereinafter referred to as "structural stability" for short).

PRIOR ART

Ultra supercritical boilers that are very effective because of using a high temperature and pressurized steam have recently been built or are under construction all over the world. The planned steam temperature will elevate from about 600° C. to 650° C., or to about 700° C. in future. Ultra supercritical boilers are very advantageous for saving energy, an efficient use of resources, and environment preservation because fossil fuels are burnt with high efficiency.

High temperature and pressurized steam increases the temperature to 650° C. or more of heat resistant pressurized parts that constitute boilers and heating furnaces. Therefore, these heat resistant pressurized parts are required to have excellent thermal fatigue properties and also a long-term structural stability, in addition to high temperature strength and corrosion resistance.

An austenitic stainless steel is superior in high temperature strength and corrosion resistance compared to a ferritic steel. Therefore, an austenitic stainless steel is used at high temperatures that exceed 650° C. because a ferritic steel lacks the necessary strength and corrosion resistance.

An 18-8 austenitic stainless steel such as SUS 347 H and SUS 316 is used as heat resistant pressurized parts, but it is insufficient in high temperature strength and a corrosion resistance. A 25Cr stainless steel such as SUS 310, improves in corrosion resistance but is insufficient in high temperature strength of 600° C. or more, which is inferior to SUS 316.

Therefore, an improvement in high temperature strength and corrosion resistance has been proposed based on austenitic stainless steels containing at least 20% of Cr, which have a better high temperature corrosion resistance than that of an 18-8 stainless steel. These proposals are classified into the following three classes.

(1) A matrix strengthened steel, which has a Cr content of 20% or more and contains solid solution strengthening elements such as W and Mo (e.g. Japanese Unexamined Patent Publication Nos. S61-179833 and S61-179835).

(2) A nitride precipitation strengthened steel containing positively added N in addition to W and Mo. (e.g. Japanese Unexamined Patent Publication No. S63-183155).

(3) A precipitation strengthened steel with intermetallic compounds comprising Ti or Al (e.g. Japanese Unexamined patent Publication H07-216511).

However, class (1) above has an insufficient high temperature creep strength at a temperatures of 700° C. or more, because grain sliding creep is more dominant at a high temperature than dislocation creep. Classes (2) or (3) above have high strength, but has very low ductility as well as low thermal fatigue properties and low structural stability at high temperatures which leads to low creep strength and ductility at a temperature of 700° C. or more.

Moreover, Class (3) above is seriously impaired in strength and toughness since a mixed, grain structure is formed because the intermetallic compounds of Ti or Al inhibit the growth of crystal grains, which causes grain sliding creep and heterogeneous creep deformation. Therefore, these prior arts cannot be applied to the heat resistant pressurized parts that have a thickness of at least 20 mm for use at high temperatures exceeding 700° C., because the steel tends to become a mixed grain structure.

SUMMARY OF THE INVENTION

It is the objective of the invention to provide an austenite stainless steel suited for use as heat resistant pressurized parts, exhibiting good thermal fatigue properties and a structural stability at high temperatures of 700° C. or more.

It is another objective of the invention to provide heat resistant pressurized parts excellent in high temperature strength and thermal fatigue properties, preferably having a creep rupture strength of not less than 80 MPa and a reduction of area of not less than 55% after creep at 750° C. for 10,000 hours.

It is also an objective of the invention to provide a manufacturing method of heat resistant pressurized parts above.

An austenitic stainless steel of the present invention is mentioned in (1) and (2), noted below. The heat resistant pressurized parts of the invention are also mentioned in (3) below. Furthermore, the manufacturing method of the parts is mentioned in (4) below.

(1) An austenitic stainless steel which consists of, by mass %, C: 0.03–0.12%, Si: 0.1–1%, Mn: 0.1–2%, Cr: not less than 20% but less than 28%, Ni: more than 35% but not more than 50%, W: 4–10%, Ti: 0.01–0.3%, Nb: 0.01–1%, sol. Al: 0.0005–0.04%, B: 0.0005–0.01%, and the balance Fe and impurities; and the impurities are restricted to P: not more than 0.04%, S: not more than 0.010%, Mo: less than 0.5%, N: less than 0.02%, and O (oxygen): not more than 0.005%.

(2) An austenitic stainless steel which consists of, in addition to the chemical composition described in (1) above, at least one alloying element selected from at least one of the first to third groups specified below.

First group: Zr of 0.0005–0.1 mass %

Second group: Ca of 0.0005–0.05 mass % and Mg of 0.0005–0.01 mass %

Third group: REM, Hf and Pd of 0.0005–0.2 mass %

Wherein, REM (rare earth metal) means 17 elements including the fifteen elements from atomic number 57 (La) to 71 (Lu), and Y and Sc.

(3) A heat resistant pressurized parts excellent in thermal fatigue property and structural stability at an high temperature, which is made of an austenitic stainless steel defined by (1) or (2) above; and has a coarse grain whose grain size number is 6 or less, and whose mixed grain ratio is 10% or less. It is preferable that the parts have a creep rupture strength of 80 MPa or more and a reduction of area of 55% or more after creep at 750° C. for 10,000 hours.

An austenitic grain size number mentioned above means a grain size number prescribed by ASTM (American Society for Testing and Material).

Mixed grain ratio is calculated as follows:

Initially, an austenitic grain size number has to be decided. In order to make a judgment of the austenitic grain size number, plural view points are observed by using an optical microscope. Herein the number of observed view points are presented as "N". An austenitic grain size are numbered from −3 (coarse grain) to +10 (fine grain).

Next, the frequency of each grain size number is calculated from the austenitic grain size numbers. Grain size number "G", whose frequency is the highest, is specified, and "n1" and "n2" are developed. Herein "n1" represents the number of view points whose grain size number is smaller by 3 than G, and "n2" represents the number of view points whose grain size number is bigger by 3 than G.

Finally, a mixed grain ratio is calculated by using the formula mentioned below.

$$\text{Mixed grain ratio}=(n1+n2)/N\times 100(\%)$$

(4) A method of manufacturing heat resistant pressurized parts, excellent in thermal fatigue properties and structural stability at high temperatures, as described in (3) above, which comprises the following steps (i) to (iii):

Step (i): heating an austenitic stainless steel consisting of chemical composition mentioned at (1) or (2) above, once or more times, at a temperature of 1,100° C. or more, prior to final hot or cold working, Step (ii): plastic working in a reduction of area of 10% or more, and Step (iii): final heat treatment at 1,050° C. or more.

DESCRIPTION OF THE PREFERRED EMBODIMENT

The present inventors made extensive investigations concerning the effects of alloying elements on a creep and structural stability at 700° C. or more of an austenitic stainless steel, having an increased Cr content exceeding 20%, for securing corrosion resistance at a high temperature and obtained the following novel findings of (a) to (f):

(a) Mo has little effect on increasing high temperature strength at 700° C. or more, and conversely causes a reduction of high temperature corrosion resistance. Therefore, it is necessary to restrict the Mo content to less than 0.5% even when it is contained as an impurity.

(b) On the contrary, W improves high temperature strength at 700° C. or more and does not reduce high temperature corrosion resistance. Hence insufficient strength due to no addition of Mo can be compensated by an addition of W.

(c) A carbonitride and an intermetallic compound containing Ti, which have been used for enhancing strength in the prior art in order to promote the grain boundary sliding creep and heterogeneous creep deformation, as mentioned above, caused marked reductions in strength and ductility in an elevated temperature range; hence it is recommended that they be not utilized as far as possible.

(d) A grain boundary sliding creep and a heterogeneous creep deformation does not occur in a coarse grained structure frequently as much as it does in a fine grained structure. It is preferable that the austenite grain size number is 6 or less and that the mixed grain ratio is 10% or less.

(e) A coarse grained structure whose austenite grain size number is 6 or less and whose mixed grain ratio is 10% or less, is necessary by using steel whose chemical composition is (1) or (2) above. In other words, it requires the Ti content to be 0.01–0.3%, the N content less than 0.02%, O (oxygen) content 0.005% or less, and B content 0.0005–0.01%. The coarse grained structure can be obtained, for instance, by treating this steel in the steps (i) to (iii) above.

Because restricting the contents of Ti, N, O and B, among alloying elements of (1) or (2) above, leads to a steel that does not have either undissolved carbonitrides containing Ti and/or B or undissolved oxides in the solid solution form after the step (i) above, and to uniform accumulation of strains during the step (ii) above, and to uniform recrystallization during the step (iii) above.

These contents and steps cause the coarse grain structure steel with the austenite grain size number of 6 or less and the mixed grain percentage of 10% or less, and can be applied to the heat resistant pressurized part.

(f) The restricted contents of Ti and Nb improve high temperature creep rupture strength by precipitating uniformly as a fine grain carbide, both inside and on the boundary of the granule during creep, in case the heat resistant pressurized parts whose structure has an austenite grain size number of 6 or less and a mixed grain ratio of 10% or less. As a result, a creep rupture strength increases to 80 MPa or more and a reduction of area increases to 55% or more after creep at 750° C. for 10,000 hours. These parts are also excellent in thermal fatigue properties.

The chemical composition of the austenitic stainless steel of the invention, a grain size number and a mixed grain ratio of heat resistant pressurized parts and preferred manufacturing conditions are explained in detail in the following. In the specification, "%" means "% by mass" unless otherwise specified.

1. Chemical Composition of the Austenitic Stainless Steel

C: 0.03–0.12%

C is an element to form a carbide and leads to high temperature strength and creep strength that is necessary for an austenitic stainless steel. It is required that the C content is not lower than 0.03%. However, the C content exceeding 0.12% causes an undissolved carbide and increases the Cr carbide content lowering a weldability, and hence an allowable upper limit is 0.12%. A desirable C content is within the range of 0.05–0.10%.

Si: 0.1–1%

Si is added as a deoxidizer during steel making and is an element necessary for increasing steam oxidation resistance of steel. The addition of at least 0.1%. However, an excessive addition reduces the workability of the steel, so the allowable upper limit is 1%. A preferred range is 0.1–0.5%.

Mn: 0.1–2%

Mn forms MnS because S is contained in steel as an impurity, and it also improves hot workability. The content of lower than 0.1% does not improve hot workability, but on the other hand, an excessive content causes hardness and brittleness, which impairs workability and weldability. Therefore, an allowable upper limit is 2%. A desirable Mn content is 0.5–1.2%.

P: not more than 0.04%

P is inevitably contained as an impurity or contaminant. An excessive content of P impairs weldability and workability, hence the allowable upper limit is 0.04%. A preferred upper limit is 0.03%. It is desirable that the P content is as low as possible.

S: not more than 0.010%

S is inevitably contained as an impurity or contaminant as well as P. An excessive S content impairs weldability and workability, hence the allowable upper limit is 0.010%. A preferred upper limit is 0.008%. The S content is preferred as low as possible because that amount will improve workability. It is preferable that the S content is 0.004–0.008% in order to improve the melting during welding.

Cr: not less than 20% but less than 28%

Cr is an important element for improving oxidation, steam oxidation and corrosion resistance. The content of at least 20% is necessary for the same corrosion resistance at a high temperature of 700° C. or more as in an 18-8 stainless steel. While the Cr content of at least 20% results in improving corrosion resistance, the Cr content of 28% or more impairs both structural stability and creep strength. The Cr content of 28% or more also leads to a low weldability and also needs to increase the Ni content in order to stabilize an austenite structure, which results in additional expense. Therefore, the Cr content should be not less than 20% but less than 28%, preferably within the range of 22–26%.

Ni: more than 35% but not more than 50%

Ni is an element capable of stabilizing an austenite structure. It is also an important alloying element for improving corrosion resistance. For keeping a balance with the Cr content, Ni is required more than 35%. On the other hand, an excessive content of Ni result in additional expense and also causes a decrease in a creep strength. Therefore, an allowable upper limit is 50%, and a desirable content is 40–48%.

Mo: less than 0.5%

Mo forms a brittle phase, reduces high temperature corrosion resistance at 700° C. or more, and further it does very little to contribute to improving the strength of the steel. Adding Mo in addition to W can attain an improvement of strength but this has the same results of adding only W. Therefore, Mo is not positively added in the present invention. The content of 0.5% or more, which may be on the level of an impurity, forms a brittle phase and reduces remarkably a corrosion resistance at a high temperature of 700° C. or more. Therefore, the content of Mo should be less than 0.5%. It is preferable that the Mo content is not more than 0.3%. It is more preferable that Mo is not more than 0.01%, which means undetectable during analysis.

W: 4–10%

W is one of the more important elements and the W content of at least 4% suppresses a grain sliding creep at a high temperature of 700° C. or more due to a solid solution strengthening. On the other hand, an excessive amount of W content causes a remarkable hardening and impairs workability and weldability, although it does not form a brittle phase, unlike Mo. Therefore, the allowable upper limit is 10%. A desirable W content is 6–8%.

Ti: 0.01–0.3%

Ti forms a carbonitride and oxide and promotes an uneven grain growth of an austenite grain to a mixed grain, which causes a heterogeneous creep deformation and reduced ductility. Therefore, the content should be not more than 0.3%. However, the Ti content of less than 0.01% does not improve high temperature strength, which is caused by carbide precipitation during use at a high temperature. Thus, the Ti content should be 0.01–0.3%, preferably 0.03–0.2%.

Nb: 0.01–1%

The Nb content of at least 0.01% is necessary to improve the creep strength due to a formation of its carbide. On the other hand, excessive Nb content does not form such a harmful oxide as Ti does, but it impairs weldability, hence an allowable upper limit is 1%. A preferred Nb content is 0.1–0.5%.

sol. Al: 0.0005–0.04%

Al is added as a deoxidizer but an excessive addition leads to poor structural stability. Thus, the sol. Al content should be not more than 0.04%. On the other hand, the sol. Al content of not less than 0.0005% is required for attaining a sufficient deoxidizing effect. A preferred sol. Al content is 0.005–0.02%.

B: 0.0005–0.01%

B is an element for suppressing a grain sliding creep in the steel of the present invention where oxides and nitrides are excluded by reducing the contents of N and O (oxygen) as low as possible. The B content of less than 0.0005% cannot suppress the creep. On the other hand, a B content exceeding 0.01% impairs weldability. Therefore, the B content should be 0.0005–0.01%. It is preferable that it is 0.001–0.005%.

N: less than 0.02%

The reduced N content is one of the important requisites of the present invention. N has been positively added as an element for carbonitride precipitation strengthening and as an element instead of Ni, which is expensive. However, a higher content of N forms a dissolved carbonitride with Ti and B and converts the steel structure to a mixed grain, which then promotes a grain sliding creep and a heterogeneous creep deformation at a high temperature of 700° C. or more. This impairs the strength of the steel. Therefore, the N content should be kept as low as possible. Cr accompanies N because of a strong affinity for N, and N inevitably exists as an impurity. The N content should be less than 0.02% because it does not form any undissolved carbonitrides. A preferred N content is not more than 0.016%, and more preferably not more than 0.01%. The lower the N content the better.

O (oxygen): not more than 0.005%

As well as N, the reduced O(oxygen) content is one of the important requisites of the present invention. O forms an undissolved oxide with Ti and Al and converts a steel structure to a mixed grain, which promotes a grain sliding creep and a heterogeneous creep deformation at a high temperature of 700° C. or more, which impairs the strength of the steel. Therefore, the O content should be as low as possible. O exists inevitably as an impurity so the content should be not more than 0.005% because it does not form any undissolved oxides. A preferred O content is not more than 0.003%. The lower O content is the better.

The balance in the austenitic stainless steel of the invention is substantially composed of Fe, or strictly speaking, the balance is Fe and impurities.

Another austenitic stainless steel consists of, in addition to the chemical composition described above, at least one alloying element selected from at least one group of the first to third groups in the following:

First group (Zr):

Zr is effective in strengthening a grain boundary and improving a high temperature strength. Therefore, it may be positively added when such effect is desired. The Zr content of 0.0005% or higher is effective, but Zr content exceeding 0.1% forms an undissolved oxide or nitride as well as Ti, which not only promotes a grain sliding creep and a heterogeneous creep deformation but also deteriorates the steel quality, such as a creep strength and ductility at a high temperature. Therefore, it is preferable that the Zr content is 0.0005–0.1%, or more preferably 0.001–0.06.

Second group (Ca and Mg):

These elements combine with S and form a stable sulphide, which improves workability. Therefore, either or both of them may be positively added if necessary. The Ca or Mg content of 0.0005% or more is effective, but the Ca content exceeding 0.05% or the Mg content exceeding 0.01% impairs the toughness and ductility of the steel. Therefore, it is preferable that the Ca content is 0.0005–0.05% and the Mg content is 0.0005–0.01%; more preferable the Ca content of 0.0005–0.01% and the Mg content of 0.001–0.005%, respectively.

Third group (rare earth elements, Hf and Pd):

These elements all form a harmless and stable oxide or sulfide and eliminate the unfavorable effect of O and S, thereby improving corrosion resistance, a workability, a creep strength and a creep ductility. Therefore, one or more of them may be positively added when such effects are desired. The content of 0.0005% or more for each of them is effective, but the content exceeding 0.2% increases an inclusion such as oxide, which impairs not only the workability and weldability but also results in additional expense. Therefore, it is preferable that the content of each of them is 0.0005–0.2%; more preferable 0.001–0.1%.

Furthermore other impurities besides P, S, Mo, N and O are Co and Cu, which may come from scraps, for instance. Co will not exert any particular adverse effect on the steel property and the heat resistant pressurized parts of the invention. Therefore, the content of Co as an impurity is not particularly restricted. However, Co is a radioactive element, hence it is preferable that the Co content is not more than 0.8%; more preferable not more than 0.5%. Cu improves strength but promotes a grain sliding creep at a high temperature of 700° C. or more. Therefore, it is preferable that the Cu content is not more than 0.5%; more preferable not more than 0.2%.

2. Heat Resistant Pressurized Parts

The heat resistant pressurized parts according to the invention, are made of an austenitic stainless steel having a chemical composition as described above. It is necessary that the steel structure has an austenite grain size number of 6 or less and a coarse grain with a mixed grain ratio of 10% or less. The reasons are as follows:

A creep strength at a high temperature of 700° C. or more largely depends on an austenite grain size and the size uniformity. A fine grain with a grain size number exceeding 6 causes a grain sliding creep. A mixed grain ratio exceeding 10% causes a heterogeneous creep deformation even if the grain size number is 6 or less. As a result, the thermal fatigue resistance and the structural stability are reduced. This reduction does not ensure the creep rupture strength of not less than 80 MPa and a reduction of area of not less than 55% for a creep rupture time of 10,000 hours at 750° C.

Therefore, in accordance with the present invention, an austenite grain size number should be 6 or less and a mixed grain ratio should be 10% or less. It is preferable that an austenite grain size number is 5.5 to 3 and a mixed grain ratio is 0 (zero) %, which means a coarse and uniform grain structure with a grain size number of 6 or less. The lower limit of the austenite grain size number is not restricted. However, a test for an internal defect or a surface flaw cannot be applied for an ultrasonic inspection in a coarse grain with a grain size number less than 0. It is preferable that the lower limit is 0.

3. A Manufacturing Method of Heat Resistant Pressurized Parts

A preferred method of manufacturing heat resistant pressurized parts of the invention is now described, which have a coarse grain with an austenite grain size number of 6 or less and a mixed grain ratio of 10% or less. The manufacturing method is characterized in the following steps (i) to (iii):

Step (i):

It is necessary to heat once or more times prior to a final hot or cold working to sufficiently dissolve those precipitates generated during working. When a heating temperature is lower than 1,100° C., a stable carbonitride or an oxide of Ti or B remains undissolved after heating, which causes an uneven accumulated strain in the next step (ii) and this leads to an uneven recrystallization in a final heat treatment step (iii). Furthermore, an undissolved carbonitride or oxide itself suppresses uniform recrystallization, which does not ensure a coarse grain. Therefore, in accordance with the preferred method of the invention, heating at 1,100° C. or more is carried out once or more times prior to a final hot or cold working. Although the upper limit to a heating temperature is not restricted, heating at a temperature exceeding 1,350° C. may cause high temperature cracking and reduce ductility. It is preferable that the allowable upper limit is 1,350° C.

A final hot or cold working can be followed immediately after the heating. The cooling condition after the heating or after the final hot working is not restricted in particular. It is desirable that a cooling rate from 800° C. to 500° C. is 0.25° C./sec or more, in order to avoid a formation of coarse precipitate during cooling.

Step (ii):

The plastic working of the steel in step (ii) implies both a hot working and cold working including warm working at a temperature not higher than 500° C., in case the final hot working was carried out in step (i) above. The plastic working also implies cold working under the same conditions as the final cold working, in case the final cold working including a warm working was carried out in step (i) above.

The plastic working in step (ii) is carried out to provide strain in order to promote recrystallization in the next final heat treatment. When the reduction of area in the working is less than 10%, the plastic working cannot provide the strain necessary for recrystallization to form the desired grain, even if the next final heat treatment is carried out. Therefore, the plastic working is carried out with a reduction of area of not less than 10%. A preferred lower limit to the reduction of area is 20%. Since a greater reduction of area is more desirable, the upper limit is not restricted. However, a maximum value in ordinary working is about 90%. The plastic working determines the size of the parts.

Step (iii):

This heat treatment is carried out in order to obtain a desired coarse grain. When the heat treatment temperature is lower than 1,050° C., sufficient recrystallization does not take place, which suppresses a desired coarse-grain and decreases a creep strength because of ununiform structure. Therefore, the final heat treatment is carried out at 1,050° C. or above. It is preferable that a heat treatment temperature is lower by at least 10° C. than a heating temperature in step (i). Although an upper limit to a final heat treatment temperature is not restricted, it is preferable if it is 1,350° C. because of the same reason as in step (i). It is also preferable to cool from a temperature of 800° C. to 500° C. at rate of 0.25° C./sec or more after a final heat treatment, because of the same reason as in step (i).

EXAMPLES 23 kinds of steel having a respective chemical composition specified in Table 1, were melted. In the comparative examples, the steel No. 21 corresponds to SUS 310, and the steel No. 22 to SUS 316.

The steel of Nos. 1 to 20 was melted using a vacuum melting furnace with a capacity of 50 kg and produced ingots. The ingot of the steel Nos. 1 to 4 and Nos. 11 to 14 were finished to a plate by the following manufacturing method A, the ingot of the steel Nos. 5 to 7 and Nos. 15 to 17 were finished to a cold rolled plate by the following manufacturing method B, and the ingots of the steel Nos. 8 to 10 and Nos. 18 to 20 were finished to a tube by the following manufacturing method C.

The steel of Nos. 21 to 29 was melted using a vacuum melting furnace with a capacity of 150 kg, and the obtained ingots were treated by the manufacturing method A, B or C, as indicated in table 2. These manufacturing methods all belong to the invention.

(1) Manufacturing Method A

Step 1: heating at 1,220° C.,

Step 2: shaping into 25-mm-thick plates by hot forging with a reduction of area of 67%, Step 3: cooling from 800° C. to 500° C. or below at a rate of 0.55° C./sec, and Step 4: maintaining at 1,210° C. for 15 minutes, followed by water quenching.

(2) Manufacturing Method B

Step 1: heating at 1,220° C.,

Step 2: shaping into 25-mm-thick plates by hot forging with a reduction of area of 67%, Step 3: cooling from 800° C. to 500° C. or below at a rate of 0.55° C./sec, Step 4: shaping into 20-mm-thick plates by outer surface cutting, Step 5: shaping into 14-mm-thick plates by room temperature rolling with a reduction of area of 30%, and Step 6: maintaining at 1,200° C. for 15 minutes, followed by water quenching.

(3) Manufacturing Method C

Step 1: shaping into round steel bars with an outside diameter of 175 mm by hot forging and outside face cutting, Step 2: heating the round steel bars at 1,250° C., Step 3: shaping the heated round steel bars into steel pipes with an outside diameter of 64 mm and a wall thickness of 10 mm by hot extrusion, Step 4: heating the steel pipes at 1,220° C. for 10 minutes, followed by cooing at a rate of 1° C./sec, Step 5: shaping into steel pipes with an outside diameter of 50.8 mm and a wall thickness of 8.5 mm by room temperature drawing with a reduction of area of 33%, and Step 6: maintaining at 1,210° C. for 10 minutes, followed by water quenching.

TABLE 1

| | Chemical Composition (the balance: Fe and impurities, mass %) | | | | | | | | | | | | | | | |
|---|---|---|---|---|---|---|---|---|---|---|---|---|---|---|---|---|
| No. | C | Si | Mn | P | S | Ni | Cr | Mo | W | Ti | Nb | B | sol.Al | N | O | Others |
| The Present Invention | | | | | | | | | | | | | | | | |
| 1 | 0.035 | 0.13 | 1.98 | 0.002 | 0.003 | 35.03 | 20.53 | 0.01 | 6.98 | 0.18 | 0.45 | 0.0010 | 0.036 | 0.002 | 0.0045 | Ca: 0.011 |
| 2 | 0.080 | 0.23 | 1.07 | 0.011 | 0.006 | 40.57 | 22.47 | 0.19 | 9.96 | 0.02 | 0.02 | 0.0096 | 0.002 | 0.018 | 0.0023 | — |
| 3 | 0.115 | 0.47 | 1.21 | 0.023 | 0.001 | 49.97 | 27.98 | 0.44 | 4.07 | 0.03 | 0.15 | 0.0033 | 0.007 | 0.003 | 0.0030 | Mg: 0.001, Zr: 0.03 |
| 4 | 0.062 | 0.57 | 1.36 | 0.024 | 0.002 | 41.35 | 25.05 | 0.32 | 7.85 | 0.13 | 0.30 | 0.0027 | 0.019 | 0.007 | 0.0025 | — |
| 5 | 0.081 | 0.22 | 1.57 | 0.007 | 0.002 | 42.08 | 24.02 | 0.22 | 8.98 | 0.20 | 0.77 | 0.0042 | 0.023 | 0.009 | 0.0016 | Zr: 0.12, Y: 0.12 |
| 6 | 0.076 | 0.11 | 0.52 | 0.005 | 0.002 | 44.21 | 23.49 | 0.09 | 6.75 | 0.11 | 0.23 | 0.0033 | 0.010 | 0.016 | 0.0017 | — |
| 7 | 0.055 | 0.18 | 0.13 | 0.003 | 0.003 | 39.00 | 22.72 | 0.12 | 6.78 | 0.05 | 0.35 | 0.0056 | 0.008 | 0.010 | 0.0021 | Hf: 0.08 |
| 8 | 0.098 | 0.98 | 1.76 | 0.014 | 0.001 | 36.13 | 21.40 | 0.41 | 5.43 | 0.28 | 0.98 | 0.0008 | 0.013 | 0.005 | 0.0027 | Mg: 0.002, Ca: 0.023 |
| 9 | 0.101 | 0.75 | 1.42 | 0.018 | 0.003 | 43.24 | 24.70 | 0.17 | 8.80 | 0.03 | 0.06 | 0.0044 | 0.009 | 0.009 | 0.0034 | — |
| 10 | 0.127 | 0.44 | 1.37 | 0.021 | 0.006 | 38.75 | 23.75 | 0.25 | 8.01 | 0.04 | 0.42 | 0.0040 | 0.021 | 0.011 | 0.0047 | Ca: 0.035 |
| 11 | 0.078 | 0.32 | 1.03 | 0.010 | 0.001 | 39.09 | 24.85 | 0.31 | 7.90 | 0.09 | 0.38 | 0.0038 | 0.016 | 0.009 | 0.0036 | Nd: 0.07, Ce: 0.07 |
| 12 | 0.070 | 0.25 | 0.95 | 0.016 | 0.002 | 49.08 | 26.42 | 0.10 | 6.61 | 0.18 | 0.50 | 0.0029 | 0.014 | 0.005 | 0.0011 | Zr: 0.07 |
| 13 | 0.089 | 0.20 | 0.85 | 0.013 | 0.003 | 42.12 | 25.01 | 0.16 | 7.22 | 0.09 | 0.37 | 0.0063 | 0.013 | 0.015 | 0.0022 | Y: 0.05 |
| 14 | 0.065 | 0.19 | 0.72 | 0.012 | 0.002 | 45.77 | 25.87 | 0.29 | 8.05 | 0.11 | 0.21 | 0.0022 | 0.021 | 0.012 | 0.0028 | Mg: 0.004 |
| 15 | 0.052 | 0.17 | 0.69 | 0.015 | 0.002 | 43.91 | 23.03 | 0.28 | 6.02 | 0.15 | 0.45 | 0.0036 | 0.005 | 0.005 | 0.0025 | Ca: 0.004, Zr: 0.11 |
| 16 | 0.067 | 0.22 | 1.08 | 0.008 | 0.003 | 37.50 | 22.45 | 0.25 | 6.76 | 0.04 | 0.48 | 0.0023 | 0.006 | 0.016 | 0.0006 | — |
| 17 | 0.076 | 0.35 | 1.36 | 0.018 | 0.001 | 42.00 | 21.70 | 0.21 | 7.03 | 0.08 | 0.51 | 0.0011 | 0.011 | 0.009 | 0.0032 | La: 0.01, Ce: 0.03, Mg: 0.002 |
| 18 | 0.053 | 0.21 | 1.20 | 0.021 | 0.001 | 41.72 | 24.52 | 0.24 | 7.24 | 0.14 | 0.36 | 0.0051 | 0.023 | 0.014 | 0.0021 | Ce: 0.05 |
| 19 | 0.073 | 0.40 | 1.06 | 0.005 | 0.002 | 40.31 | 23.71 | 0.31 | 7.35 | 0.17 | 0.60 | 0.0028 | 0.016 | 0.013 | 0.0024 | — |
| 20 | 0.069 | 0.24 | 0.55 | 0.016 | 0.008 | 39.42 | 25.03 | 0.17 | 6.98 | 0.13 | 0.44 | 0.0010 | 0.016 | 0.006 | 0.0015 | Pd: 0.005 |
| Comparative | | | | | | | | | | | | | | | | |
| 21 | 0.075 | 0.56 | 1.42 | 0.038 | 0.003 | *19.85 | 24.47 | — | — | — | — | — | 0.023 | *0.075 | 0.0049 | |
| 22 | 0.067 | 0.37 | 1.20 | 0.025 | 0.002 | *12.75 | *17.85 | *2.38 | — | — | — | — | 0.022 | *0.058 | 0.0042 | |
| 23 | 0.089 | 0.50 | 1.08 | 0.026 | 0.002 | 35.46 | 22.40 | 0.49 | 9.03 | *0.45 | 0.89 | 0.0025 | 0.018 | *0.055 | 0.0041 | |
| 24 | 0.124 | 0.21 | 1.43 | 0.016 | 0.002 | 47.89 | 23.55 | *0.75 | 9.67 | 0.29 | 0.95 | 0.0018 | 0.003 | *0.041 | 0.0032 | |
| 25 | 0.115 | 0.36 | 0.95 | 0.030 | 0.003 | 42.07 | 24.21 | 0.26 | 8.02 | 0.25 | 0.58 | 0.0045 | 0.018 | 0.018 | *0.0055 | |
| 26 | 0.120 | 0.42 | 0.74 | 0.036 | 0.002 | 36.00 | 26.71 | 0.01 | 9.24 | 0.28 | 0.36 | 0.0037 | 0.002 | *0.079 | 0.0047 | |
| 27 | 0.078 | 0.33 | 0.87 | 0.016 | 0.002 | 38.95 | 26.03 | 0.47 | *10.42 | 0.26 | 0.92 | 0.0021 | 0.016 | 0.016 | 0.0044 | |
| 28 | 0.089 | 0.31 | 0.98 | 0.013 | 0.005 | 41.08 | 22.08 | 0.32 | 4.02 | 0.09 | 0.87 | *0.0116 | 0.004 | 0.019 | *0.0067 | |
| 29 | 0.075 | 0.61 | 1.32 | 0.018 | 0.004 | 37.62 | 23.65 | 0.31 | 5.74 | 0.07 | 0.47 | 0.0046 | 0.003 | *0.029 | *0.0072 | |

Note:
Symbol * implies out of scope of the present invention.

The hot-worked steel plate, cold-rolled steel plate or cold-worked steel tube obtained by the above methods A, B or C were examined for an austenite grain size number and a mixed grain ratio. An austenite grain size number was measured in accordance with the method defined by the ASTM. A mixed grain ratio was determined by the method described above. On that occasion, 20 visual fields were observed in each case.

Further, creep test specimens with an outside diameter of 6 mm and a gauge length of 30 mm were taken from the hot-worked steel plates, cold-rolled steel plates and cold-worked steel pipes obtained by the above method A, B or C, and subjected to a creep testing at 750° C. for 10,000 hours. A creep rupture strength (MPa) and a reduction of area (interpolated value: %) were determined for each specimen. The results are summarized in Table 2.

TABLE 2

| | | Austenite Grain | | Creep Property | |
|---|---|---|---|---|---|
| | | Average | | (750° C. × 10,000 hrs) | |
| No. | Manufacturing Method | Grain Size Number (ASTM Number) | Mixed Grain Ratio (%) | Creep Rupture Strength (MPa) | Ruptured Reduction of Area (%) |
| The Present Invention | | | | | |
| 1 | A | 4.2 | 0 | 87 | 67 |
| 2 | | 3.6 | 0 | 95 | 72 |
| 3 | | 4.5 | 0 | 114 | 57 |
| 4 | | 4.7 | 0 | 88 | 66 |
| 5 | B | 4.9 | 5 | 98 | 78 |
| 6 | | 3.7 | 10 | 92 | 60 |
| 7 | | 3.3 | 0 | 105 | 77 |
| 8 | C | 4.1 | 5 | 121 | 65 |
| 9 | | 3.1 | 0 | 90 | 71 |
| 10 | | 4.2 | 0 | 96 | 70 |
| 11 | A | 5.1 | 10 | 101 | 75 |
| 12 | | 4.8 | 5 | 112 | 77 |
| 13 | | 5.9 | 5 | 99 | 73 |
| 14 | | 4.7 | 10 | 107 | 79 |
| 15 | B | 5.1 | 10 | 117 | 72 |
| 16 | | 4.3 | 5 | 94 | 68 |
| 17 | | 5.3 | 0 | 114 | 75 |
| 18 | C | 4.3 | 5 | 101 | 68 |
| 19 | | 5.7 | 0 | 91 | 61 |
| 20 | | 5.0 | 0 | 109 | 79 |
| Comparative | | | | | |
| 21 | C | 4.5 | 5 | 41* | 75 |
| 22 | C | 3.8 | 10 | 55* | 62 |
| 23 | B | 8.2* | 30* | 68* | 4* |
| 24 | C | 7.2* | 30* | 78* | 13* |
| 25 | A | 5.7 | 25* | 77* | 19* |
| 26 | B | 7.4* | 35* | 72* | 9* |
| 27 | C | 7.8* | 10 | 74* | 11* |
| 28 | A | 5.2 | 30* | 78* | 23* |
| 29 | A | 6.8 | 35* | 45* | 7* |

Note:
Symbol * implies out of scope of the present invention.

As is evident from Table 2, each of those steel (Nos. 1 to 20), whose respective chemical composition falls within scope of the present invention, when manufactured by any of the method A, B or C, can acquire an austenite grain size number and a mixed grain ratio falling within scope of the invention. It is evident that heat resistant pressurized parts, showing a high creep rupture strength of not less than 87 MPa and a high reduction in an area of not less than 57% in creep testing at 750° C. for 10,000 hours, and excellent in thermal fatigue properties and a structural stability, can be obtained from the steel above.

The steel No. 21 (SUS 310) and No. 22 (SUS 316) have a coarse grain satisfying the conditions within scope of the invention but the chemical composition is out of scope of the invention, hence the creep rupture strength is remarkably low, which means 41 MPa and 55 MPa, respectively.

The steel (Nos. 23 to 29), whose respective chemical composition is out of scope of the invention, even if treated by the manufacturing process of the present invention, fails to give a coarse grain so that both an austenite grain size number and a mixed grain ratio fall within scope of the invention. As a result, a creep rupture strength is as low as 68–78 MPa, and the reduction of area is as low as 4–23%. No. 25 has an excessively high O (oxygen) content, and No. 26 has an excessively high N content. In No. 29, the O content and N content are both excessively high. The creep rupture strength and a reduction of area are comparably lower than the aim, indicating the importance of reducing the O and N contents. Thus, these comparative steels cannot be applied to the heat resistant pressurized parts, because these do not exhibit a good thermal fatigue property and a structural stability at high temperatures of 700° C. or more.

INDUSTRIAL APPLICABILITY

The austenitic stainless steel of the invention is suited for use as a material for heat resistant pressurized parts required to have a coarse grain that has an austenite grain size number is 6 or less and a mixed grain ratio is 10% or less. The austenite stainless steel is excellent in thermal fatigue properties and a structural stability at a high temperature of 700° C. or more. The heat resistant pressurized parts according to the invention, show a creep rupture strength as high as 87 MPa and a reduction of area as high as 57% in creep testing at 750° C. for 10,000 hours and therefore can be used as parts constituting a ultra supercritical boiler where the steam temperature reaches 700° C. or more. Furthermore, a manufacturing method of the invention leads to resistant and pressurized parts at low cost.

What is claimed is:

1. An austenitic stainless steel characterized by consisting of, by mass %, C: 0.03–0.12%, Si: 0.1–1%, Mn: 0.1–2%, Cr: not less than 20% but less than 28%, Ni: more than 35% but not more than 50%, W: 4–10%, Ti: 0.01–0.3%, Nb: 0.01–1%, sol. Al: 0.0005–0.04%, B: 0.0005–0.01%, and the balance Fe and impurities; and also characterized by the impurities whose contents are restricted to P: not more than 0.04%, S: not more than 0.010%, Mo: less than 0.5%, N: less than 0.02%, and O (oxygen): not more than 0.005%, and further characterized by having a coarse grain whose grain size number is 6 or less and whose mixed grain ratio is 10% or less.

2. Heat resistant pressurized parts excellent in thermal fatigue property and structural stability at high temperatures, which are made of an austenitic stainless steel according to claim 1.

3. Heat resistant pressurized parts according to claim 2, characterized by having a creep strength of 80 MPa or more and a reduction of area of 55% or more for a creep rupture time of 10,000 hours at 750° C.

4. An austenitic stainless steel characterized by consisting of, by mass %, C: 0.03–0.12%, Si: 0.1–1%, Mn: 0.1–2%, Cr: not less than 20% but less than 28%, Ni: more than 35% but not more than 50%, W: 4–10%, Ti: 0.01–0.3%, Nb: 0.01–1%, sol. Al: 0.0005–0.04%, B: 0.0005–0.01%, and at least one alloying element selected from at least one group mentioned below, and the balance Fe and impurities; and also characterized by the impurities whose contents are restricted to P: not more than 0.04%, S: not more than 0.010%, Mo: less than 0.5%, N: less than 0.02%, and O (oxygen): not more than 0.005%, and further characterized by having a coarse grain whose grain size number is 6 or less and whose mixed grain ratio is 10% or less, the first group: Zr of 0.0005–0.1 mass %, the second group: Ca of 0.0005–0.05 mass % and, the third group: REM, Hf and Pd of 0.0005–0.2 mass %, respectively.

5. Heat resistant pressurized parts excellent in thermal fatigue property and structural stability at high temperatures, which are made of an austenitic stainless steel according to claim 4.

6. Heat resistant pressurized parts according to claim 5, characterized by having a creep strength of 80 MPa or more and a reduction of area of 55% or more for a creep rupture time of 10,000 hours at 750° C.

7. An austenitic stainless steel characterized by consisting of, by mass %, C: 0.03–0.12%, Si: 0.1–1%, Mn: 0.1–2%, Cr: not less than 20% but less than 28%, Ni: more than 35% but not more than 50%, W: 6–10%, Ti: 0.01–0.3%, Nb: 0.01–1%, sol. Al: 0.0005–0.04%, B: 0.0005–0.01%, and the balance Fe and impurities; and also characterized by the impurities whose contents are restricted to P: not more than 0.04%, S: not more than 0.010%, Mo: less than 0.5%, N: less than 0.02%, and O (oxygen): not more than 0.005%, and further characterized by having a coarse grain whose grain size number is 6 or less and whose mixed grain ratio is 10% or less.

8. Heat resistant pressurized parts excellent in thermal fatigue property and structural stability at high temperatures, which are made of an austenitic stainless steel according to claim 7.

9. Heat resistant pressurized parts according to claim 8, characterized by having a creep strength of 80 MPa or more and a reduction of area of 55% or more for a creep rupture time of 10,000 hours at 750° C.

10. An austenitic stainless steel characterized by consisting of, by mass %, C: 0.03–0.12%, Si: 0.1–1%, Mn: 0.1–2%, Cr: not less than 20% but less than 28%, Ni: more than 35% but not more than 50%, W: 6–10%, Ti: 0.01–0.3%, Nb: 0.01–1%, sol. Al: 0.0005–0.04%, B: 0.0005–0.01%, and at least one alloying element selected from at least one group mentioned below, and the balance Fe and impurities; and also characterized by the impurities whose contents are restricted to P: not more than 0.04%, S: not more than 0.010%, Mo: less than 0.5%, N: less than 0.02%, and O (oxygen): not more than 0.005%, and further characterized by having a coarse grain whose grain size number is 6 or less and whose mixed grain ratio is 10% or less, the first group: Zr of 0.0005–0.1 mass %, the second group: Ca of 0.0005–0.05 mass, and the third group: REM, Hf and Pd of 0.0005–0.2 mass %, respectively.

11. Heat resistant pressurized parts excellent in thermal fatigue properties and a structural stability at high temperatures, which is made of an austenitic stainless steel according to claim 10.

12. Heat resistant pressurized parts according to claim 11, characterized by having a creep strength of 80 MPa or more and a reduction of area of 55% or more for a creep rupture time of 10,000 hours at 750° C.

* * * * *